US007216658B1

(12) United States Patent
Navarro

(10) Patent No.: US 7,216,658 B1
(45) Date of Patent: May 15, 2007

(54) PORTABLE VEHICLE SHELTER

(76) Inventor: Arthur Navarro, 9512 Chanticleer Rd., Anaheim, CA (US) 92804

( * ) Notice: Subject to any disclaimer, the term of this patent is extended or adjusted under 35 U.S.C. 154(b) by 185 days.

(21) Appl. No.: 10/812,194

(22) Filed: Mar. 29, 2004

(51) Int. Cl.
*E04H 15/40* (2006.01)

(52) U.S. Cl. ..... 135/143

(58) Field of Classification Search ..... 135/88.08, 135/88.06, 88.13, 129, 132, 143, 117
See application file for complete search history.

(56) References Cited

U.S. PATENT DOCUMENTS

| | | | | | |
|---|---|---|---|---|---|
| 1,603,785 | A | * | 10/1926 | Marbury | 135/87 |
| 1,784,115 | A | * | 12/1930 | Sebell | 135/88.08 |
| 1,836,060 | A | * | 12/1931 | Barnes | 135/88.13 |
| 2,598,940 | A | * | 6/1952 | Robie | 135/133 |
| 2,798,501 | A | | 7/1957 | Oliver | |
| 2,995,137 | A | * | 8/1961 | Cothern | 135/88.08 |
| 3,476,127 | A | * | 11/1969 | Holt | 135/125 |
| 4,164,233 | A | | 8/1979 | McAndrew | |
| 4,402,544 | A | * | 9/1983 | Artim et al. | 296/110 |
| 4,605,030 | A | | 8/1986 | Johnson | |
| 4,655,236 | A | | 4/1987 | Dorame et al. | |
| 4,944,321 | A | | 7/1990 | Moyet-Ortiz | |
| 5,040,557 | A | * | 8/1991 | Morgan | 135/88.05 |
| 5,094,257 | A | | 3/1992 | Wilson et al. | |
| 5,806,549 | A | * | 9/1998 | Love | 135/143 |
| 6,502,596 | B1 | | 1/2003 | Danaher | |
| 2003/0015232 | A1 | * | 1/2003 | Nguyen | 135/87 |
| 2004/0123892 | A1 | * | 7/2004 | Kim | 135/88.08 |

FOREIGN PATENT DOCUMENTS

| | | |
|---|---|---|
| FR | 2.583.812 | 12/1986 |
| GB | 1.449.321 | 9/1976 |
| GB | 1.033.938 | 7/1978 |
| GB | 1.522.367 | 8/1978 |

* cited by examiner

*Primary Examiner*—Tamara L. Graysay
(74) *Attorney, Agent, or Firm*—Michael I. Kroll

(57) ABSTRACT

An apparatus for a portable pop-up carport for automobiles 18, sports utility vehicles and small trucks comprising a foldable frame structure 32 having a light weight waterproof roof 20, side panels of mesh-like material 22 and optional front and rear panels. Bungee cord 24 and hook members 34 are provided to secure and anchor the pop-up carport 10 to the vehicle's bumpers 26 and anchor rings 28 are provided to further secure the device to the ground 30. The device 10 is designed to provide shade from the sun and help cool the air within a vehicle 18 parked beneath the device. When the user is finished with the use of the pop-up 10, they simply fold it up and secure it with a VELCRO, hook and loop, strap 38.

8 Claims, 10 Drawing Sheets

PORTABLE VEHICLE SHELTER

BACKGROUND OF THE INVENTION

1. Field of the Invention

The present invention relates generally to portable shelters and, more specifically, to a portable pop-up carport for automobiles, sports utility vehicles and small trucks comprising a foldable frame structure having a light weight waterproof roof, side panels of mesh like material and optional front and rear panels. Bungee cord and hook members are provided to secure and anchor the pop-up carport to the vehicle's bumpers and anchor rings are provided to further secure the device to the ground. The device is designed to provide shade from the sun and help cool the air within a vehicle parked beneath the device. When the user is finished with the use of the pop-up, they simply fold it up and secure it with a Velcro strap. The device is not recommended as a permanent car port or to be used on windy days.

2. Description of the Prior Art

There are other portable carports designed for this purpose. Typical of these is U.S. Pat. No. 2,798,501 issued to Oliver on Jul. 9, 1957.

Another patent was issued to McAndrew on Aug. 14, 1979 as U.S. Pat. No. 4,164,233. Yet another U.S. Pat. No. 4,605,030 was issued to Johnson on Aug. 12, 1986 and still yet another was issued on Apr. 7, 1987 to Dorame, et al. as U.S. Pat. No. 4,655,236.

Another patent was issued to Moyet-Ortiz on Jul. 31, 1990 as U.S. Pat. No. 4,944,321. Yet another U.S. Pat. No. 5,040,557 was issued to Morgan on Aug. 20, 1991. Another was issued to Wilson, et al. on Mar. 10, 1992 as U.S. Pat. No. 5,094,257 and still yet another was issued on Jan. 7, 2003 to Danaher U.S. Pat. No. 6,502,596.

Another patent was issued to Greenhalgh on Jul. 4, 1978 as Canadian Patent No. 1033938. Yet another U.K. Patent No. 1,522,367 was issued to Haynes on Aug. 23, 1978. Another was issued to Hrytzak on Sep. 15, 1976 as U.K. Patent No. 1,449,321 and still yet another was issued on Jun. 25, 1985 to Tavenaux as French Patent No. 2,583,812.

U.S. Pat. No. 2,798,501

Inventor: James F. Olivia

Issued: Jul. 9, 1957

A collapsible cover for automobiles comprising a basic frame formed of two parts pivotally interconnected at one end for pivotal movement from a superposed position to a substantially in line position, the interconnected ends of the basic frame parts being turned up and intersecting at a point removed from the plane of the remainder of the basic frame parts with the pivotal interconnection located at the intersection; a counterbalance spring connected between the two parts, and extending from a point on the turned up portion of one frame part spaced from the pivotal interconnection in the direction of the end of the turned up portion thereof to a point on the other frame part spaced from the pivotal interconnection in the direction opposite the end of the turned up portion thereof, whereby the movement of one frame part between superposed position and in line position with respect to the other frame part is counterbalanced with the minimum counterbalance force existing at a position intermediate the two positions and increasing with pivotal movement of the one frame part in either direction from the intermediate position; a plurality of hooks pivotally carried by the frame parts intermediate their respective ends, a free end of at least one hoop on a first of the frame parts extending beyond the point of pivotal connection thereof with its respective frame parts, a spring connected at one end of the free end of the hoop and at its other end to the frame at a point removed from its first connection generally in the direction of the pivotal connection between the frame parts to urge the hoop to pivot toward superposed relation with its frame part away from the pivotal interconnection of the frame parts; an anchoring pad secured to a second of the frame parts and adapted to receive an automobile wheel thereupon for anchoring the cover; a pliant material secured to the hoops and adapted to cover substantially the expanse of the frame and hoops when the frame parts are in in-line position; and a freely pivotable handle associated with the first frame part for pivoting the same between superposed and in-line relationship with the second frame part.

U.S. Pat. No. 4,164,233

Inventor: James R. McAndrew

Issued: Aug. 14, 1979

A portable device for covering vehicles comprising attaching clamps for connecting to the front and rear of the vehicle, extendable rods attached at one end to the clamps and extending above the vehicle, and a waterproof covering extendable over the vehicle and attachable in a fixed position at either end to the rods.

U.S. Pat. No. 4,605,030

Inventor: Jefrey K. Johnson

Issued: Aug. 12, 1986

A portable shelter primarily designed as a sunshade for automobiles which includes a pair of collapsible, hoop structures whose upper portions support a fabric shade and whose lower portions are hinged to pads on which the vehicle's tires are parked. A pair of collapsible compression members are locked between the sides of the hoops to maintain the hoops in shade providing positions.

U.S. Pat. No. 4,655,236

Inventor: Elizabeth S. Dorame

Issued: Apr. 7, 1987

A portable carport includes a foldable cover supported at its four corners by four telescoping assemblies each including an outwardly inclined telescoping mast. Each mast includes first and second anchoring legs, each having a foot wedged between the ground and the front and rear portions of the tread of the vehicle, respectively. A lateral anchoring assembly attached to each mast includes a lateral member having a plate which presses against an upper portion of the side wall of the adjacent tire and a clamp device that extends across the tread to engage the opposite inner wall of that tire and pulls the mast toward the tire, forcing the plate against the outer side wall, thereby maintaining the mast at a fixed angle of inclination relative to the plane of the tire. A removable spacer resting on the roof of the automobile pushes the center of the flexible cover upward to provide an air space between it and the top of the automobile. This allows rainfall to run off the top of the cover.

U.S. Pat. No. 4,944,321

Inventor: Francisco Moyet-Ortiz

Issued: Jul. 31, 1990

A combination portable vehicle garage and tent structure incorporating support members which in the garage mode are retained under the wheels of the vehicle which support members have a framework of support poles and cross members with a cover to shelter the vehicle which structure, when a vehicle is not positioned therein, can be utilized as a tent.

U.S. Pat. No. 5,040,557

Inventor: Larry Morgan

Issued: Aug. 20, 1991

A vehicle cover system has front and rear frames disposed to be suspended at a single support point at the front and a single support point at the rear of a vehicle, midway between the sides of the vehicle, preferably at the front and rear license plate mounting means. A cover having a transverse peak attaches to the front and rear frames and extends over the vehicle and down the sides. A carrier is disposed intermediate the ends of the vehicle, rests on the vehicle and extends downwardly at the sides of the vehicle and lifts the cover away from the top and the sides of the vehicle. The cover is held clear of the front and rear of the vehicle by the frames, allowing air to circulate between the vehicle and the cover. The front and rear frames and the carrier telescope in order to be stored and the front and rear frames may be locked in place.

U.S. Pat. No. 5,094,257

Inventor: Marguerite Wilson, et al.

Issued: Mar. 10, 1992

A portable and temporarily installable vehicle cover is supported by a frame, which in turn is supported by brackets attached to the vehicle rocker panels or floor pan. Alternatively the brackets may be secured to stakes which are secured in the ground near the midpoint of each side of the vehicle. The frame is formed of a forward, central and rear support. Each end of the forward support is secured to the brackets, while each end of the rear support is secured to the corresponding ends of the front support. The front and rear supports provide support for the cover, while the cover itself serves to locate and support the center support. The frame may be formed of telescoping tubular sections joined by springs, enabling the entire apparatus to be disassembled and stored within otherwise unused space such as the interior of a vehicle bumper. Alternatively, the cover may be left in its erected state if secured to stakes, and one end may be opened to allow for the entrance or exit of a vehicle.

U.S. Pat. No. 6,502,596

Inventor: Thomas C. Danaher

Issued: Jan. 7, 2003

An elongated portable structure for use as a tent or the like, having at least one end panel. The end panel has a sheet of substantially non-stretchable flexible fabric material disposed in a generally upright orientation. Two hoops of flexible, resilient, strip material are attached to the sheet. The sheet has portions in the spaces within the hoops to maintain the hoops taut and to resist collapse or distortion of the hoops. A flexible fabric cover extends from the end panel to provide shelter for a person occupying the structure. The hoops are capable of being twisted into a flat coil of reduced diameter for storage. The structure may have a second end panel with hoops, similar to the first end panel.

Canadian Patent Number 1033938

Inventor: William Greenhalgh

Issued: Jul. 4, 1978

A compact cabin unit which adjusts to be carried on a vehicle top while compacted and can be opened and used for private quarters for people to eat or sleep therein, or for other camping activities on arrival at a stopping place on a journey, and importantly a unit which adapts to be carried on small or large vehicles including vans, pickups and wagons.

U.K. Patent Number 1 522 367

Inventor: Reginald Frank Haynes

Issued: Aug. 23, 1978

A cover assembly for protecting a stationary or parked motor car against the heat of the sun, the assembly comprising brackets for attachment to roof gutters or door frames at spaced locations on opposite sides of the motor car, supports for engagement with the brackets or engaged therewith, the supports extending transversely across the top of the motor car spaced relation above the car roof, a flexible sheet member to extend over the supports with parts to the front and rear of the motor car including connecting means comprising guy lines for attachment to suitable anchorage points on the vehicle in such a manner that the sheet material is held and maintained taut above the car roof, the sheet further including a portion extending to the side of the vehicle with support means to maintain same generally horizontal to provide an awning to one side of the motor car.

U.K. Patent Number 1 449 321

Inventor: Lewis David Hrytzak

Issued: Sep. 15, 1976

A sun shield for screening automobiles, the shield comprising a first telescope rod which, in use, extends longitudinally along the automobile, and two further telescope rods extending transversely across the first telescopic rod and fixedly attached thereto in spaced parallel relation to form a planar framework, a sheet of flexible screening material supported by the framework, support means attached to each end of the further telescopic rod for spacing the framework from the body work of the automobile, and means for detachably securing the framework on the bodywork.

French Patent Number FR2583812

Inventor: Jacqueline Tavenaux

Issued: Dec. 26, 1986

The invention relates to a parasol intended to shelter vehicles parked for a prolonged duration from the sun. It consists of a canopy stretched above the roof without touching it and supported at its four corners by support which are solidly fixed to the car. It is presented in three versions: the first is made up of short systems fixed to the body and in which the four canopy supports are screwed in order to be used; the second is made up of foldable support rods fixed to the bumpers; the third is made up of retractable supports which may not be motorized.

While these portable shelters may be suitable for the purposes for which they were designed, they would not be as suitable for the purposes of the present invention, as hereinafter described.

SUMMARY OF THE PRESENT INVENTION

The present invention discloses a portable pop-up carport for automobiles, sports utility vehicles and small trucks comprising a foldable frame structure having a light weight waterproof roof, side panels of mesh-like material and optional front and rear panels. Bungee cord and hook members are provided to secure and anchor the pop-up carport to the vehicle's bumpers and anchor rings are provided to further secure the device to the ground. The device is designed to provide shade from the sun and help cool the air within a vehicle parked beneath the device. When the user is finished with the use of the pop-up, they simply fold it up and secure it with a Velcro strap.

A primary object of the present invention is to provide a portable pop-up carport for automobiles, sports utility vehicles and small trucks.

Another object of the present invention is to provide a portable pop-up carport for automobiles comprising a foldable frame structure having a light weight waterproof roof, side panels of mesh like material and optional front and rear panels.

Yet another object of the present invention is to provide a portable pop-up carport for automobiles having bungee cord and hook members are provided to secure and anchor the pop-up carport to the vehicle's bumpers.

Another object of the present invention is to provide a portable pop-up carport for automobiles having anchor rings are provided to further secure the device to the ground.

Yet another object of the present invention is to provide a portable pop-up carport for automobiles that is designed to provide shade from the sun and help cool the air within a vehicle parked beneath the device.

Additional objects of the present invention will appear as the description proceeds.

The present invention discloses a portable pop-up carport for automobiles, sports utility vehicles and small trucks comprising a foldable frame structure having a light weight waterproof root side panels of mesh-like material and optional front and rear panels. Bungee cord and hook members are provided to secure and anchor the pop-up carport to the vehicle's bumpers and anchor rings are provided to further secure the device to the ground. The device is designed to provide shade from the sun and help cool the air within a vehicle parked beneath the device. When the user is finished with the use of the pop-up, they simply fold it up and secure it with a VELCRO, book and loop, strap.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
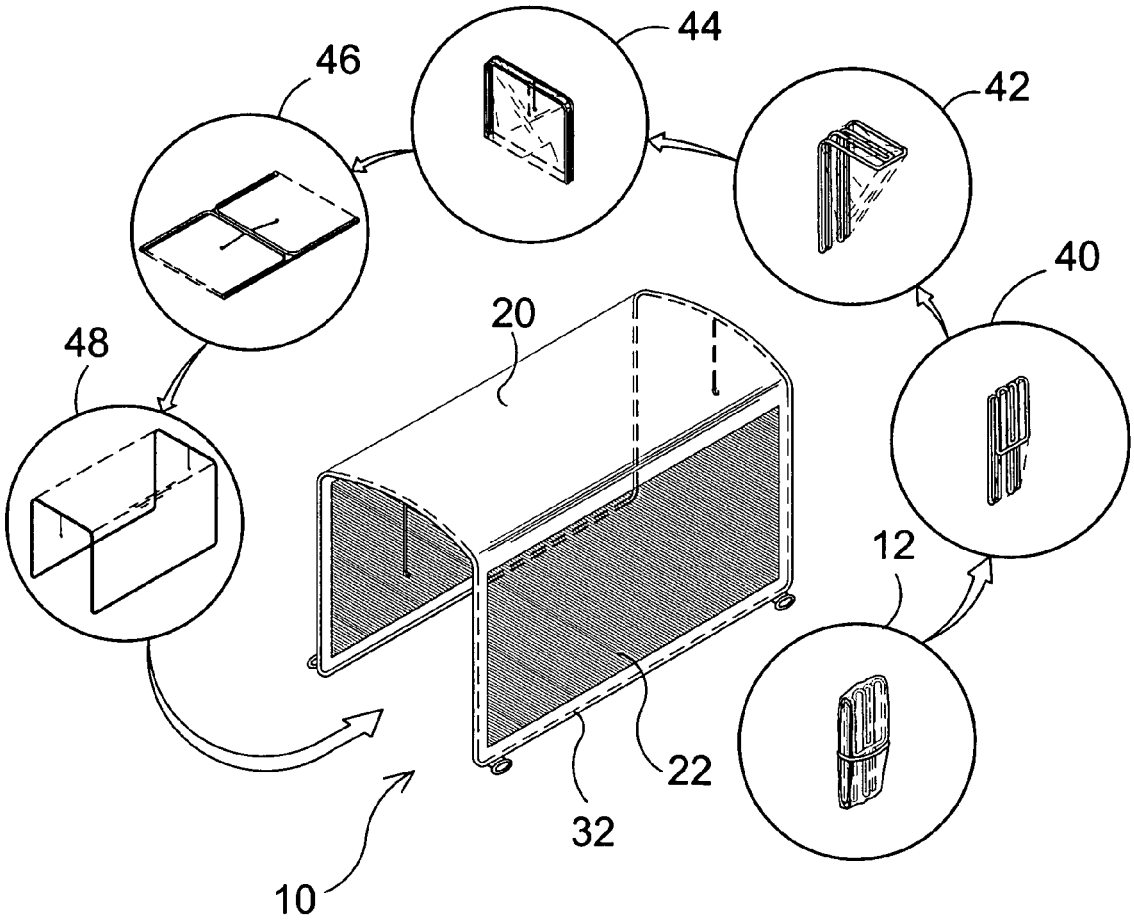
FIG. 1 is an illustrative view of the present invention.

With regard to reference numerals used, the following numbering is used throughout the drawings.

10 present invention
12 present invention folded
14 trunk
16 parking space
18 vehicle
20 roof
22 mesh side panels
24 cord
26 bumper
28 anchor ring
30 ground
32 frame
34 hook
36 arrows
38 hook and loop strap

40 stage of unfolding
42 stage of unfolding
44 stage of unfolding
46 stage of unfolding
48 stage of unfolding
50 upright end member
52 lower horizontal member
54 upper roof member
56 dimension line

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 showing the stages at 40–48 of unfolding the present invention from its folded condition 12. The present invention 10 comprises a portable pop-up carport for automobiles, sports utility vehicles and small trucks comprising a foldable frame structure 32 having a light weight waterproof roof 20 side panels of mesh like material 22 and optional front and rear panels. Bungee cord and hook members are provided to secure and anchor the pop-up carport 10 to the vehicle's bumpers and anchor rings are provided to further secure the device to the ground. The device 10 is designed to provide shade from the sun and help cool the air within a vehicle parked beneath the device. When the user is finished with the use of the pop-up 10, they simply fold it up and secure it with a VELCRO, hook and loop, strap. The device 10 is not recommended as a permanent carport or to be used on windy days.

Figure 2:
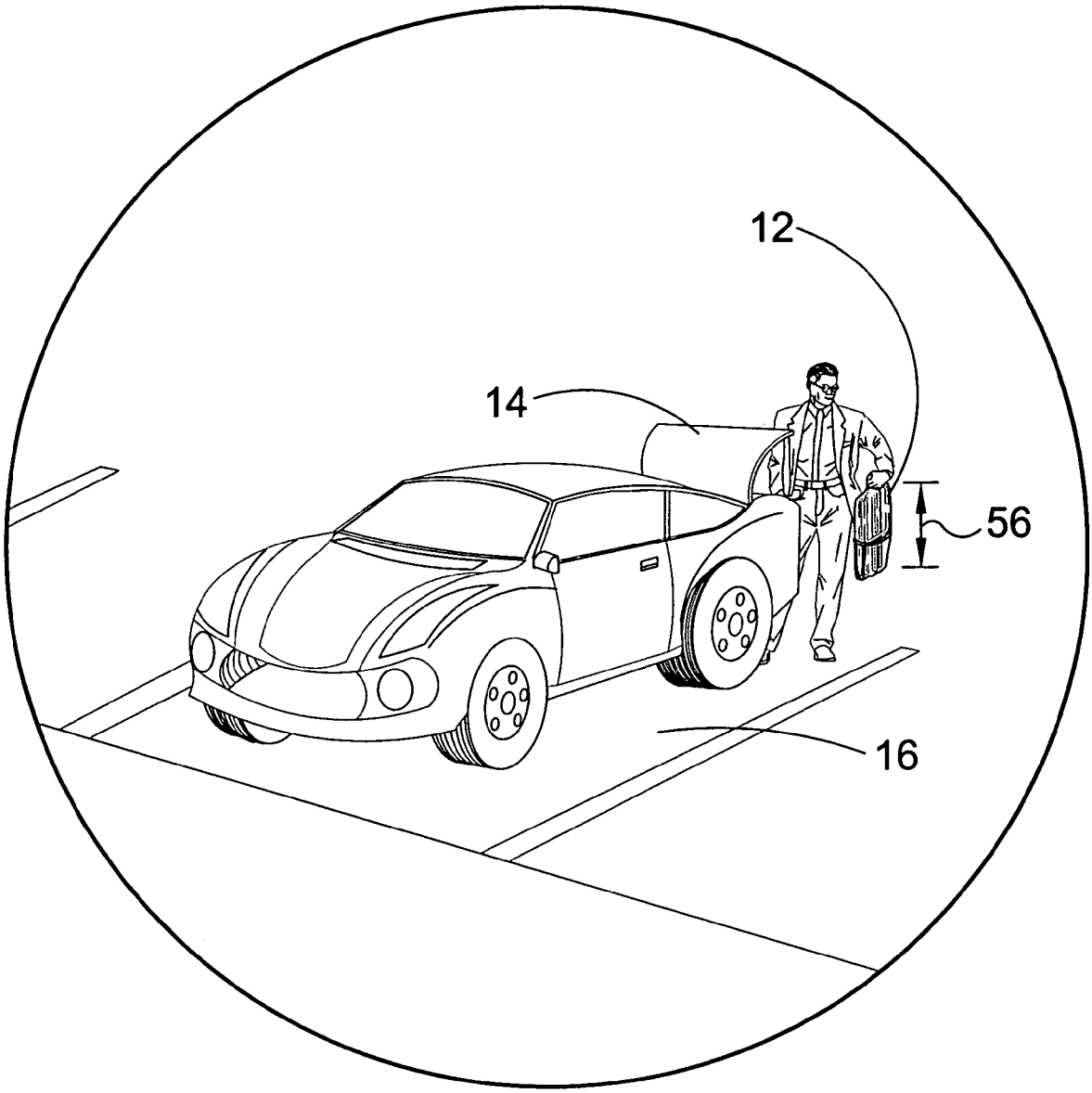
FIG. 2 is an illustrative view of the present invention prior to use.

Turning to FIG. 2, shown therein is an illustrative view of the present invention prior to use. Shown is the present invention comprising a portable pop-up carport for automobiles, sports utility vehicles and small trucks comprising a foldable frame structure having a light weight waterproof roof, side panels of mesh like material and optional front and rear panels. Bungee cord and hook members are provided to secure and anchor the pop-up carport to the vehicle's bumpers and anchor rings are provided to further secure the device to the ground. The device is designed to provide shade from the sun and help cool the air within a vehicle parked beneath the device. When the user is finished with the use of the pop-up, they simply fold it up at 12 to a length of about 36 inches as shown at 56 and secure it with a VELCRO, hook and loop, strap. The device 12 can be stored in the trunk 14 of a vehicle parked in parking space 16.

Figure 3:
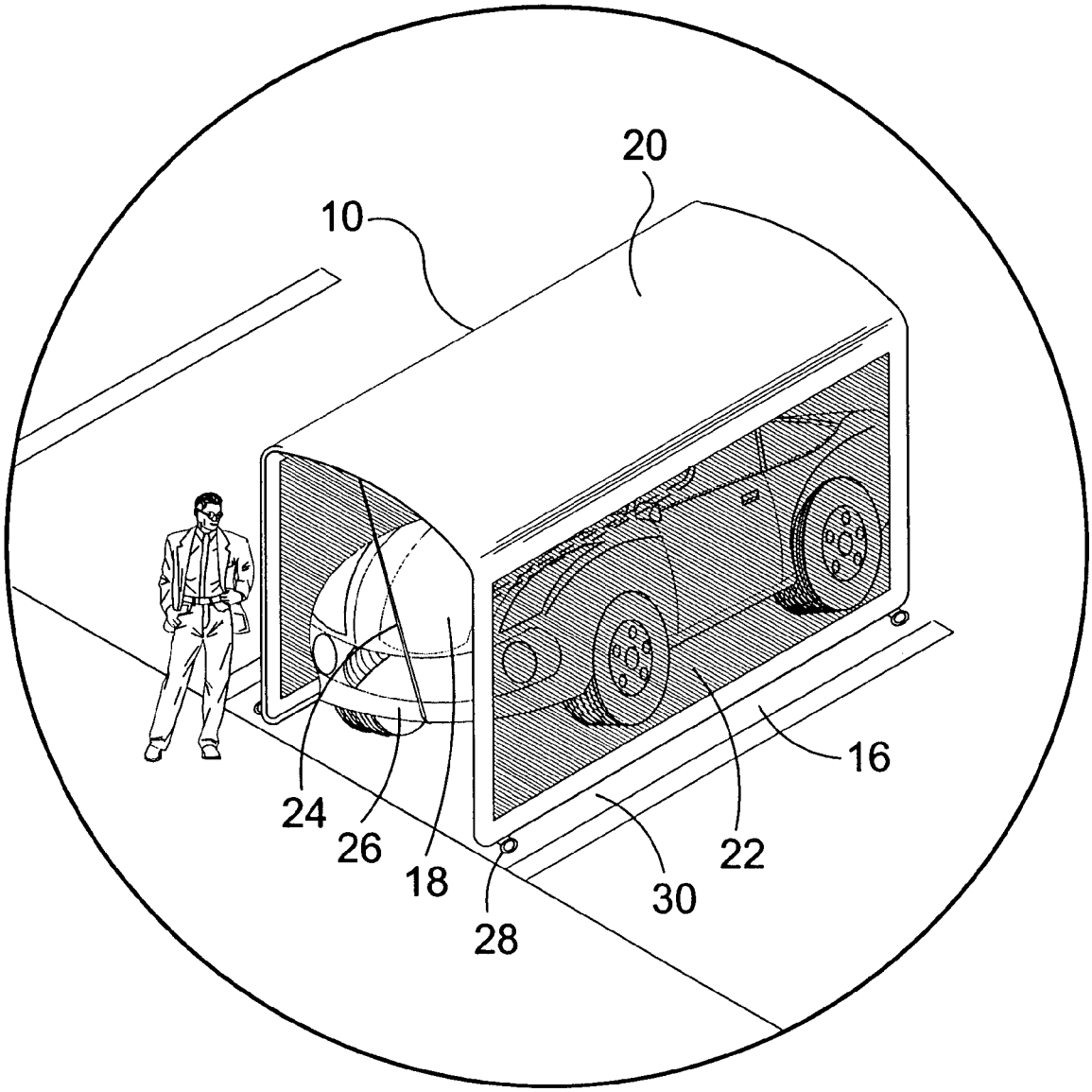
FIG. 3 is an illustrative view of the pop-up carport of the present invention in use.

Turning to FIG. 3, shown therein is an illustrative view of the pop-up carport of the present invention 10 in use. Shown is the present invention 10 comprising a portable pop-up carport for automobiles 18, sports utility vehicles and small trucks comprising a foldable frame structure having a light weight waterproof roof 20, side panels of mesh like material 22 and optional front and rear panels. Bungee anchor cord 24 and hook members are provided to secure and anchor the pop-up carport to the vehicle's bumpers 26 and anchor rings 28 are provided to further secure the device to the ground 30. The device 10 is designed to provide shade from the sun and help cool the air within a vehicle 18 parked beneath the device. When the user is finished with the use of the pop-up 10, they simply fold it up and secure it with a VELCRO, hook and loop, strap. Also shown is parking space 16.

Figure 4:
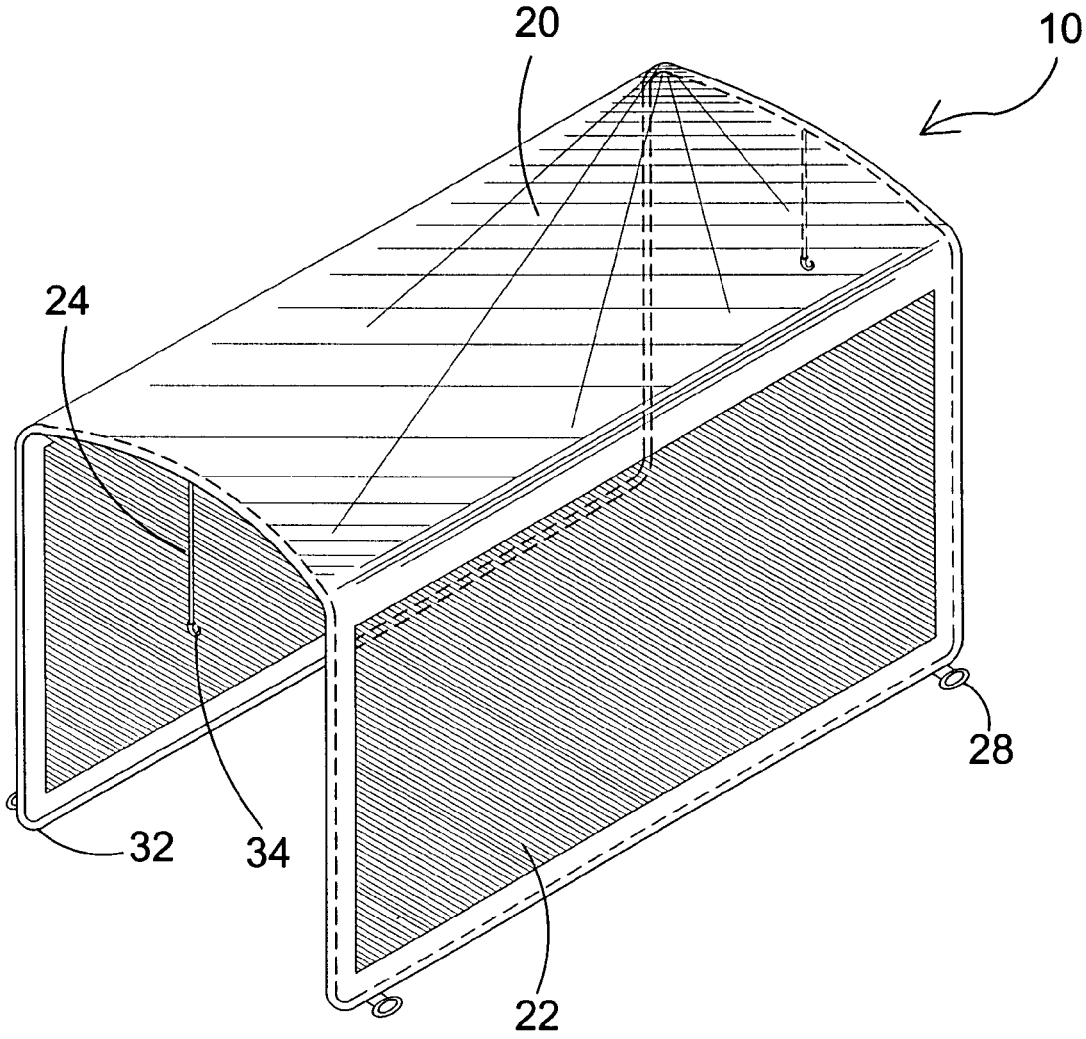
FIG. 4 is a perspective view of the present invention fully deployed.

Turning to FIG. 4, shown therein is a perspective view of the present invention 10 fully deployed. Shown is the present invention 10 comprising a portable pop-up carport for automobiles, sports utility vehicles and small trucks comprising a foldable frame structure having a light weight waterproof roof 20, side panels of mesh-like material 22 and optional front and rear panels. Bungee anchor cord 24 and hook members 34 are provided to secure and anchor the pop-up carport to the vehicle's bumpers and anchor rings 28 are provided to further secure the device to the ground. The device 10 is designed to provide shade from the sun and help cool the air within a vehicle parked beneath the device. When the user is finished with the use of the pop-up 10, they simply fold it up and secure it with a VELCRO, hook and loop, strap.

Figure 5:
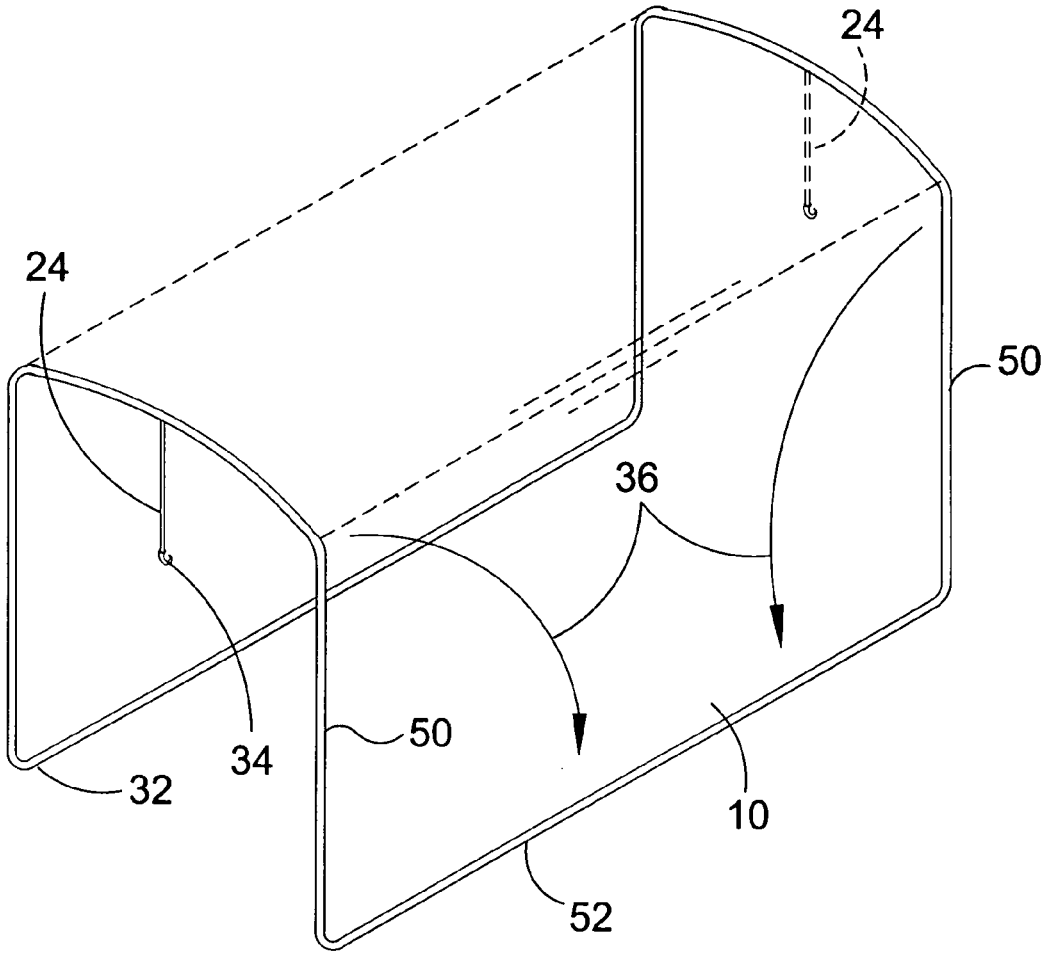
FIG. 5 is a perspective view of the present invention fully deployed.

Turning to FIG. 5, shown therein is a perspective view of the frame 32 of the present invention 10 fully deployed. Shown is the present invention 10 comprising a portable pop-up carport for automobiles, sports utility vehicles and small trucks comprising a foldable frame structure 32 made of carbon fiber material having a light weight waterproof root side panels of mesh like material and optional front and rear panels. Bungee cord 24 and hook members 34 are provided to secure and anchor the pop-up carport to the vehidle's bumpers and anchor rings are provided to further secure the device to the ground. The device 10 is designed to provide shade from the sun and help cool the air within a vehicle parked beneath the device. When the user is finished with the use of the pop-up 10, they simply fold it up as shown by arrows 36 and secure it with a VELCRO, hook and loop, strap. Arrows 36 show the upright end members 50 being folded down onto the horizontal members 52.

Figure 6:
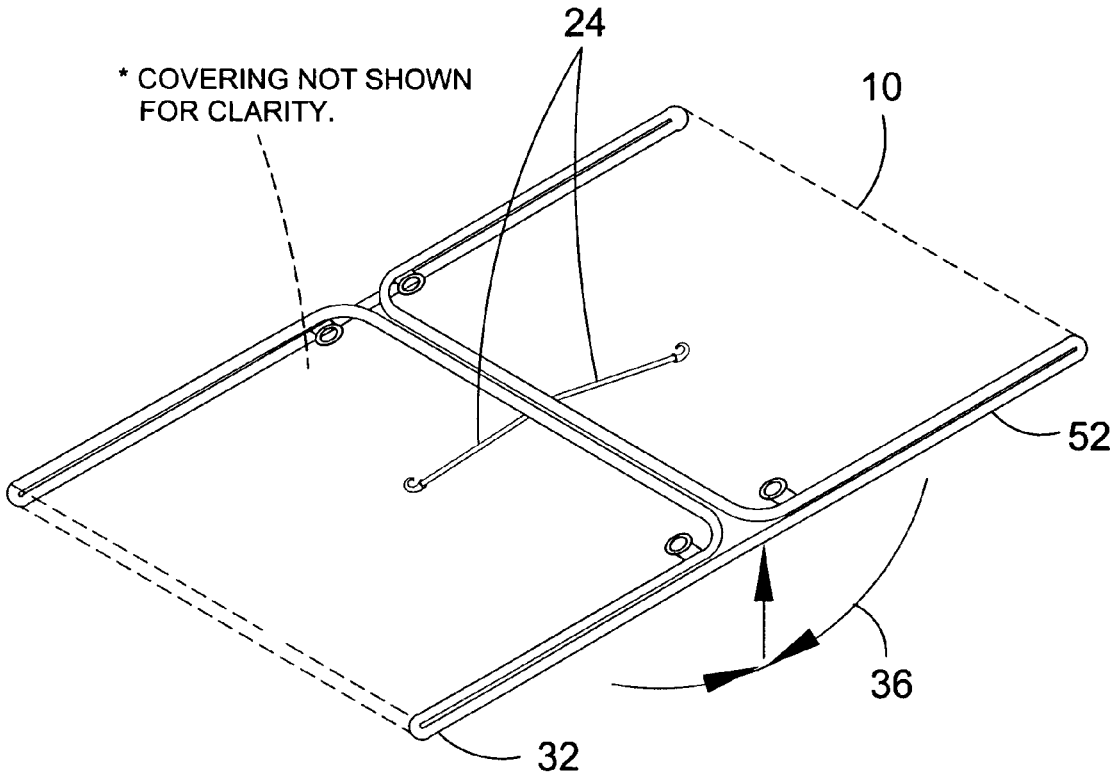
FIG. 6 is a perspective view of the present invention partially folded.

Turning to FIG. 6, shown therein is a perspective view of the present invention 10 partially folded. Shown is the present invention 10 comprising a portable pop-up carport for automobiles, sports utility vehicles and small trucks comprising a foldable frame structure 32 having a light weight waterproof roof, side panels of mesh like material and optional front and rear panels. Bungee cord 24 and hook members are provided to secure and anchor the popup carport to the vehicle's bumpers and anchor rings are provided to further secure the device to the ground. The device 10 is designed to provide shade from the sun and help cool the air within a vehicle parked beneath the device. When the user is finished with the use of the pop-up, they simply fold it up as shown by arrows 36 and secure it with a VELCRO, hook and loop, strap. Arrows 36 show the end of the horizontal members being folded in half toward each other so that the ends are adjacent each other.

Figure 7:
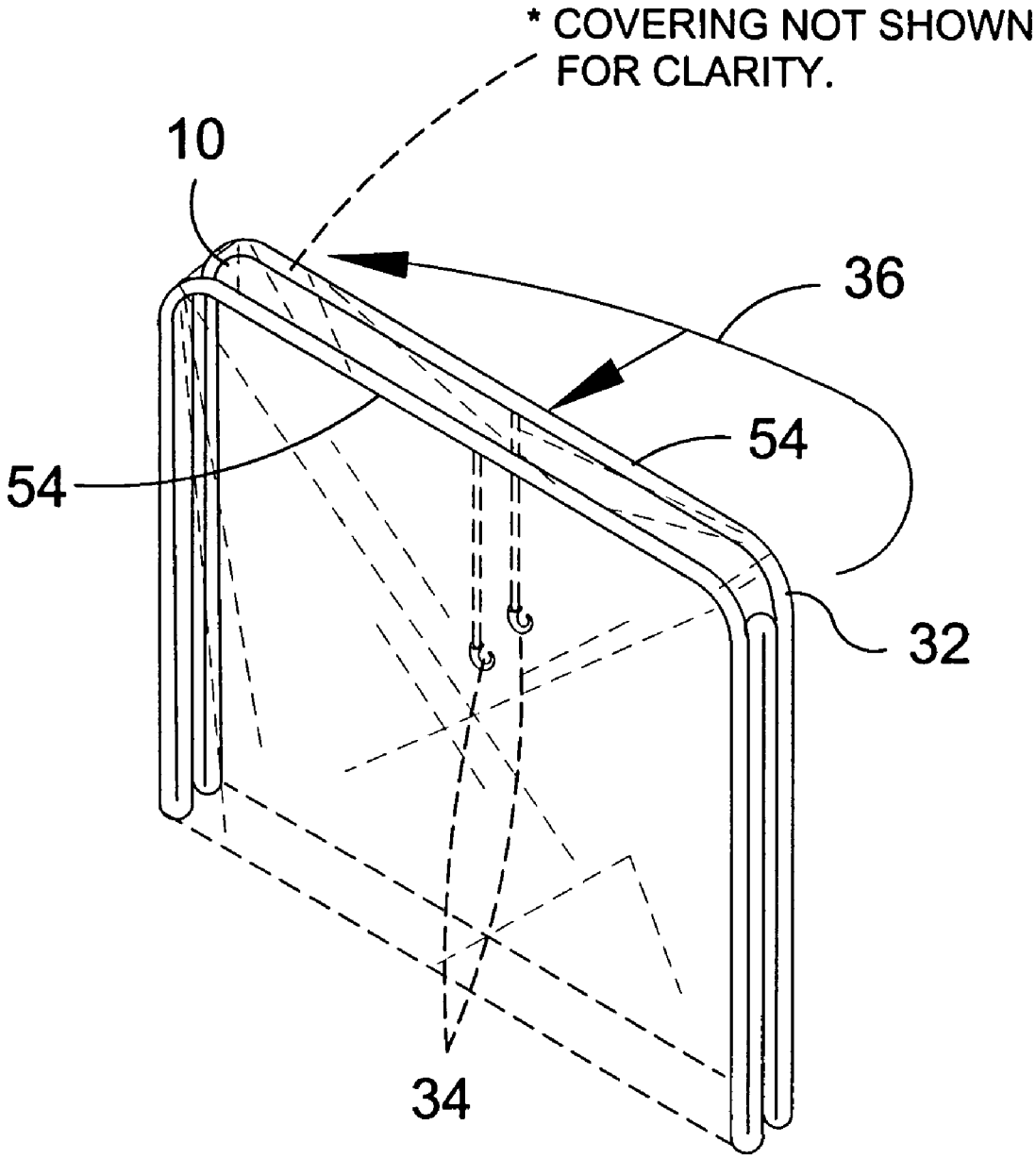
FIG. 7 is a perspective view of the present invention partially folded.

Turning to FIG. 7, shown therein is a perspective view of the present invention 10 partially folded. Shown is the present invention 10 comprising a portable pop-up carport for automobiles, sports utility vehicles and small trucks comprising a foldable frame structure 32 having a light weight waterproof roof, side panels of mesh like material and optional front and rear panels. Bungee cord and hook members 34 are provided to secure and anchor the pop-up carport 10 to the vehicle's bumpers and anchor rings are provided to further secure the device to the ground. The device 10 is designed to provide shade from the sun and help cool the air within a vehicle parked beneath the device.

When the user is finished with the use of the pop-up 10, they simply fold it up as shown by arrows 36 and secure it with a VELCRO, hook and loop, strap. Arrows 36 show the ends of the upper horizontal roof members 54 being folded toward each other.

Figure 8:
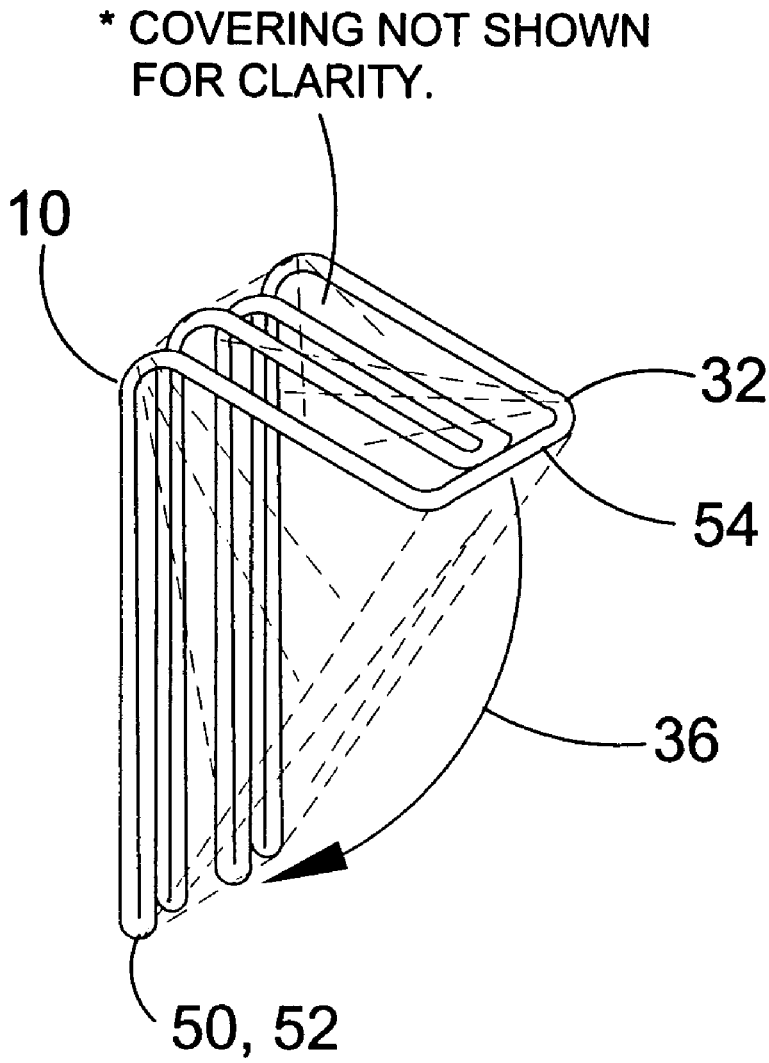
FIG. 8 is a perspective view of the present invention partially folded.

Turning to FIG. 8, shown therein is a perspective view of the present invention 10 partially folded. Shown is the present invention 10 comprising a portable pop-up carport for automobiles, sports utility vehicles and small trucks comprising a foldable frame structure 32 having a light weight waterproof roof, side panels of mesh like material and optional front and rear panels. Bungee cord and hook members are provided to secure and anchor the pop-up carport 10 to the vehicle's bumpers and anchor rings are provided to further secure the device to the ground. The device 10 is designed to provide shade from the sun and help cool the air within a vehicle parked beneath the device. When the user is finished with the use of the pop-up 10, they simply fold it up as shown by arrows 36 and secure it with a VELCRO, hook and loop, strap. Arrows 36 show the roof members 54 being folded toward the junction of the upright member 50 and lower horizontal member 52.

Figure 9:
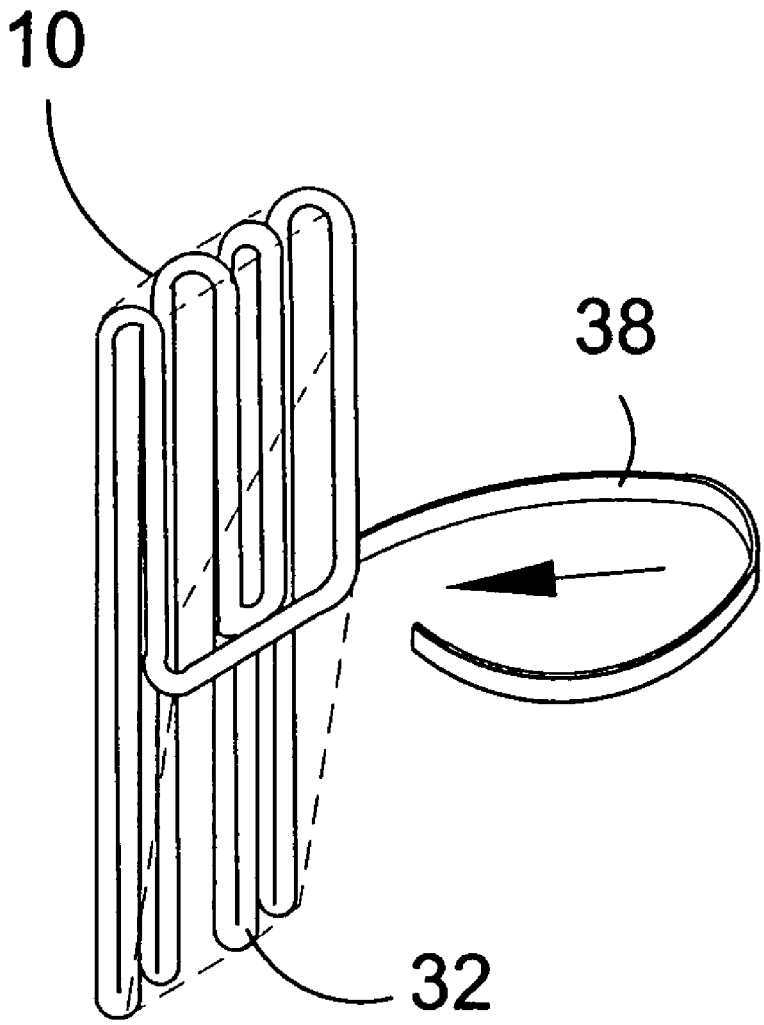
FIG. 9 is a perspective view of the present invention fully folded.

Turning to FIG. 9, shown therein is a perspective view of the present invention 10 fully folded. Shown is the present invention 10 comprising a portable pop-up carport for automobiles, sports utility vehicles and small trucks comprising a foldable frame structure 32 having a light weight waterproof root side panels of mesh like material and optional front and rear panels. Bungee cord and hook members are provided to secure and anchor the popup carport 16 to the vehicle's bumpers and anchor rings are provided to further secure the device to the ground. The device 10 is designed to provide shade from the sun and help cool the air within a vehicle parked beneath the device. When the user is finished with the use of the pop-up 10, they simply fold it up and secure it with a VELCRO, hook and loop, strap 38 as shown wherein the strap is being wrapped around the present invention 10.

Figure 10:
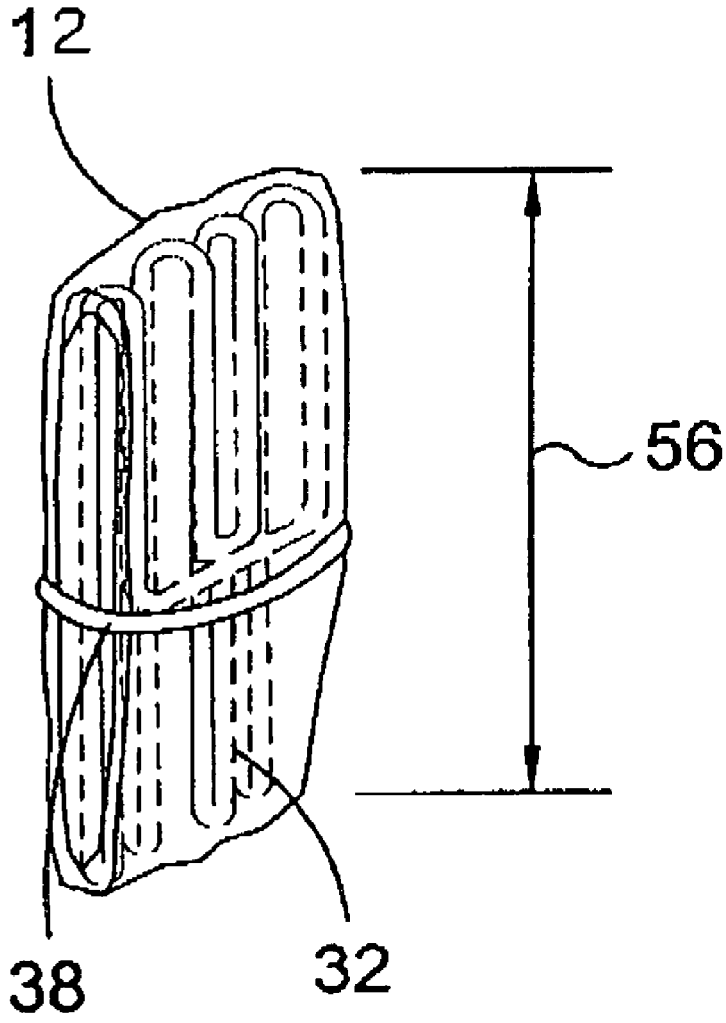
FIG. 10 is a perspective view of the present invention fully folded.

Turning to FIG. 10, shown therein is a perspective view of the present invention 10 fully folded. Shown is the present invention 10 comprising a portable pop-up carport for automobiles sports utility vehicles and small trucks comprising a foldable frame structure 32 having a light weight waterproof roof, side panels of mesh like material and optional front and rear panels. Bungee cord and hook members are provided to secure and anchor the pop-up carport 10 to the vehicle's bumpers and anchor rings are provided to further secure the device to the ground. The device 10 is designed to provide shade from the sun and help cool the air within a vehicle parked beneath the device. When the user is finished with the use of the pop-up 10, they simply fold it up to a length of about 36 inches as shown at 56 and secure it with a VELCRO, hook and loop, strap 38.

What is claimed is:

I claim:

1. A portable shelter for a vehicle, the vehicle having a front and rear bumper, comprising:

a) a foldable support frame member having a pair of spaced horizontal portions for resting on a ground surface, upright portions at each end of said horizontal portions, and roof portions extending between top ends of upright portions at each end of said horizontal portions forming front and rear openings between said spaced horizontal portions for said vehicle to enter and exit said support frame;

b) a roof of waterproof fabric material being disposed on said roof portions to permit the vehicle to be covered;

c) a pair of side panels made of mesh like material extending down from said roof to said spaced horizontal portions for protecting sides of the vehicle;

d) a pair of anchor cords each having a first end connected to said support frame member and a second end adapted to be connected to a vehicle bumper to permit the portable shelter to be secured to the vehicle; and, e) said support frame member being foldable in sequence at said ends of said horizontal portions with said upright portions being foldable toward each other and flush against said horizontal portions, said horizontal portions being foldable at midpoints thereof with said upright portions coming together, said roof portions being foldable so that said upright portions come together, and said roof portions being foldable inwardly toward said vertical portions wherein said support frame member, roof, and side panels are foldable to a compact size for storage within a trunk of the vehicle.

2. The portable shelter of claim 1, wherein the vehicle is supported on said ground surface, and further comprising a plurality of anchor rings being disposed around said support frame member, wherein said anchor rings are secured to the ground surface to permit the portable shelter to be adapted to be secured to the ground surface.

3. The portable shelter of claim 2, wherein each said anchor cord is bungee cord.

4. The portable shelter of claim 3, wherein said second end of each said anchor cord comprises a hook for connection to the vehicle bumper.

5. The portable shelter of claim 4, further comprising a strap being disposed around the folded portable shelter to permit the folded portable shelter to be securely folded.

6. The portable shelter of claim 5, wherein said strap comprises hook and loop material.

7. The portable shelter of claim 6, wherein the portable shelter folds to a size being about 36 inches long on its longest side.

8. The portable shelter of claim 7, wherein said support frame member is made of carbon fiber material.

* * * * *